US007950974B2

(12) United States Patent
Rui

(10) Patent No.: US 7,950,974 B2
(45) Date of Patent: May 31, 2011

(54) WEED CUTTER FOR A CRAFT PROPELLED BY A WATER JET

(75) Inventor: Yuting Rui, Ann Arbor, MI (US)

(73) Assignee: Surfango, Inc., Ypsilanti, MI (US)

( * ) Notice: Subject to any disclaimer, the term of this patent is extended or adjusted under 35 U.S.C. 154(b) by 15 days.

(21) Appl. No.: 11/845,289

(22) Filed: Aug. 27, 2007

(65) Prior Publication Data

US 2009/0061704 A1 Mar. 5, 2009

(51) Int. Cl.

| | |
|---|---|
| ***B63H 11/00*** | (2006.01) |
| ***B63H 11/01*** | (2006.01) |
| ***B63H 11/08*** | (2006.01) |
| ***F03B 3/16*** | (2006.01) |
| ***F03B 11/00*** | (2006.01) |

(52) U.S. Cl. ..... 440/38; 440/46; 415/121.1

(58) Field of Classification Search ..... 440/38, 440/40–43, 46, 47; 60/221, 222; 415/121.1, 415/121.3, 147, 183–195

See application file for complete search history.

(56) References Cited

U.S. PATENT DOCUMENTS

| | | | | |
|---|---|---|---|---|
| 2,434,700 | A | 8/1946 | Keckley | |
| 3,043,260 | A | 10/1960 | Tank | |
| 3,187,708 | A * | 6/1965 | Fox | 440/41 |
| 3,262,413 | A | 7/1966 | Douglas et al. | |
| 3,292,373 | A | 12/1966 | Tado | |
| 3,324,822 | A | 6/1967 | Carter, III | |
| 3,328,961 | A * | 7/1967 | Aschauer | 60/222 |
| 3,369,518 | A | 2/1968 | Jacobson | |
| 3,408,976 | A | 11/1968 | Ellis | |
| 3,426,724 | A | 2/1969 | Jacobson | |
| 3,463,116 | A | 8/1969 | Dawson | |
| 3,481,303 | A | 12/1969 | Tate et al. | |
| 3,548,778 | A | 12/1970 | Von-Smagala-Romanon | |
| 3,608,512 | A | 9/1971 | Thompson | |
| 3,882,815 | A | 5/1975 | Bennett | |
| 4,020,782 | A | 5/1977 | Gleason | |
| 4,047,494 | A | 9/1977 | Scott | |
| 4,229,850 | A | 10/1980 | Arcouette | |
| 4,237,812 | A | 12/1980 | Richardson | |
| 4,274,357 | A | 6/1981 | Dawson | |
| 4,321,048 | A | 3/1982 | Marchese et al. | |
| 4,457,724 | A | 7/1984 | Miyamoto | |

(Continued)

FOREIGN PATENT DOCUMENTS

DE 3942673 A1 * 7/1991

(Continued)

OTHER PUBLICATIONS

International Search Report issued in corresponding application PCT/US08/074333 (Jan. 23, 2009).

(Continued)

*Primary Examiner* — Ajay Vasudeva

(74) *Attorney, Agent, or Firm* — St. Onge Steward Johnston & Reens LLC

(57) ABSTRACT

A device for cutting weeds carried by water inducted into a housing includes an intake, an outlet, an impeller for pumping water from the intake to the outlet as the impeller rotates about an axis, the impeller including a blade formed with a leading edge facing the intake, and a baffle secured against movement and including a cutting edge located adjacent the leading edge when the leading edge rotates to the location of the cutting edge.

14 Claims, 4 Drawing Sheets

U.S. PATENT DOCUMENTS

| | | | |
|---|---|---|---|
| D276,994 | S | 1/1985 | Montgomery et al. |
| 4,497,631 | A | 2/1985 | Belanger |
| 4,538,996 | A | 9/1985 | Inwood |
| 4,589,365 | A | 5/1986 | Masters |
| 4,765,075 | A | 8/1988 | Nakase et al. |
| 4,781,141 | A | 11/1988 | Webb et al. |
| 4,942,838 | A | 7/1990 | Boyer et al. |
| 5,017,166 | A | 5/1991 | Chang |
| 5,096,446 | A | 3/1992 | Tazaki et al. |
| 5,209,683 | A | 5/1993 | Imaeda et al. |
| 5,254,024 | A | 10/1993 | Kobayashi et al. |
| 5,481,997 | A | 1/1996 | Arndt |
| 5,582,529 | A | 12/1996 | Montgomery |
| 5,628,269 | A | 5/1997 | Henmi et al. |
| 5,759,074 | A | 6/1998 | Jones |
| 5,769,674 | A | 6/1998 | Stallman |
| 5,839,927 | A | 11/1998 | Thomas |

FOREIGN PATENT DOCUMENTS

| | | |
|---|---|---|
| FR | 2617793 | 2/1989 |
| JP | 1148694 | 6/1989 |
| JP | 3295791 | 1/1991 |
| JP | 11-286296 | 10/1999 |

OTHER PUBLICATIONS

Written Opinion issued in corresponding application PCT/US08/074333 (Jan. 23, 2009).

English language abstract for JP 11-286296.

English language machine translation of JP 11-286296 obtained from Japanese Patent Office website.

English language machine translation of FR2617793 obtained from European Patent Office website (www.espacenet.com).

English language abstract for JP 1148694 obtained from European Patent Office website (www.espacenet.com).

English language abstract for JP 3295791 obtained from European Patent Office website (www.espacenet.com).

Machine-generated English translation of DE3942673 from the European Patent Office website (www.ep.espacent.com); Inventor: Merz Josef Dipl Ing [DE]; Publication date: Jul. 4, 1991; 2 pages.

* cited by examiner

WEED CUTTER FOR A CRAFT PROPELLED BY A WATER JET

BACKGROUND OF THE INVENTION

1. Field of the Invention

This invention relates generally to an apparatus for a watercraft propelled by a water jet. In particular, the invention pertains to a device for cutting weeds and other debris contained in water inducted into the propulsion system.

2. Description of the Prior Art

A jet-boat is a boat propelled by a jet of water ejected from the back of the craft. Unlike a powerboat or motorboat that uses a propeller in the water behind the boat, a jet-boat draws the water from under the boat into a pump-jet inside the boat, then expels it through a nozzle at the stern.

Jet-boats are highly maneuverable, and can be reversed and brought to a stop within a short distance from full speed.

A conventional screw impeller accelerates a large volume of water by a small amount, similar to the way an airplane's propeller accelerates a large volume of air by a small amount. By contrast, an aircraft's jet engine accelerates a small volume of air by a large amount. In a jet-boat, pumping a small volume of water, accelerating it by a large amount, and expelling the water above the water line delivers thrust that propels the craft. The acceleration of the water is achieved by using an impeller.

Jet-boats normally plane across the water surface, with only the rear portion of the hull displacing any water. With the majority of the hull clear of the water, drag is reduced and maneuverability is enhanced. For stability, a jet-boat has a very shallow-angled hull. At speed, jet-boats can be safely operated in less than 12 inches (30 cm) of water.

Jet-boats are frequently operated in shallow fresh water where waterweeds flourish. These weeds grow in long strands that are often drawn into the water induction and propulsion system can become entangled with the impeller blades, shafts and ducting, and can clog the propulsion system. In extreme cases, the induction and propulsion system can become so filled with weeds and debris that the engine is stalled or water cannot be pumped at a rate that satisfactorily propels the craft. When this occurs, the craft must be removed from the water and the weeds removed manually.

There is a need in the industry for an effective, safe and reliable technique for cutting waterweeds and debris inducted into the propulsion system into lengths that are short enough to flow through the intake duct and impeller and out the nozzle without collecting there or impeding water flow through the propulsion system.

SUMMARY OF THE INVENTION

A device for cutting weeds carried by water inducted into a housing includes an intake, an outlet, an impeller for pumping water from the intake to the outlet as the impeller rotates about an axis, the impeller including a blade formed with a leading edge facing the intake, and a baffle secured against movement and including a cutting edge located adjacent the leading edge when the leading edge rotates to the location of the cutting edge.

The device has no moving parts, produces virtually no power loss, and is simple and effective. The baffle is easily mounted on the interior surface of the intake duct by a few conventional fasteners such as bolts or screws. The cutting edges formed on the baffle are spaced by a narrow gap from rotating edge of the rotating impeller blades, impeller hub and drive shaft such that weeds are chopped and cut into short lengths continually while engine power is transmitted to the impeller.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
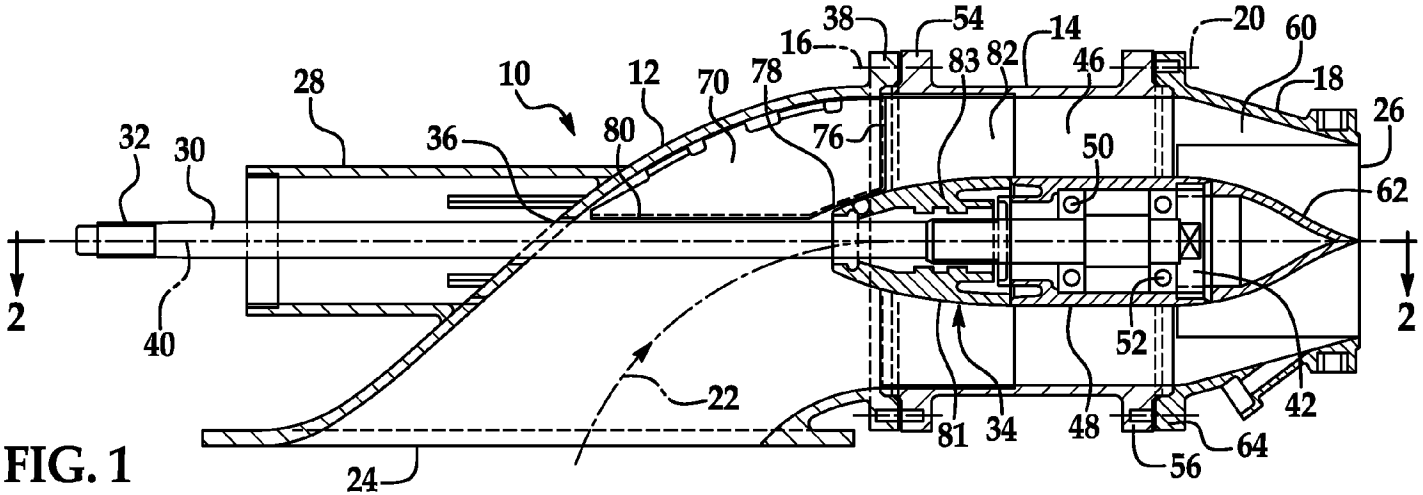
FIG. 1 is a cross-sectional side view of a water induction system for use in a watercraft propelled by a jet stream.
Figure 2:
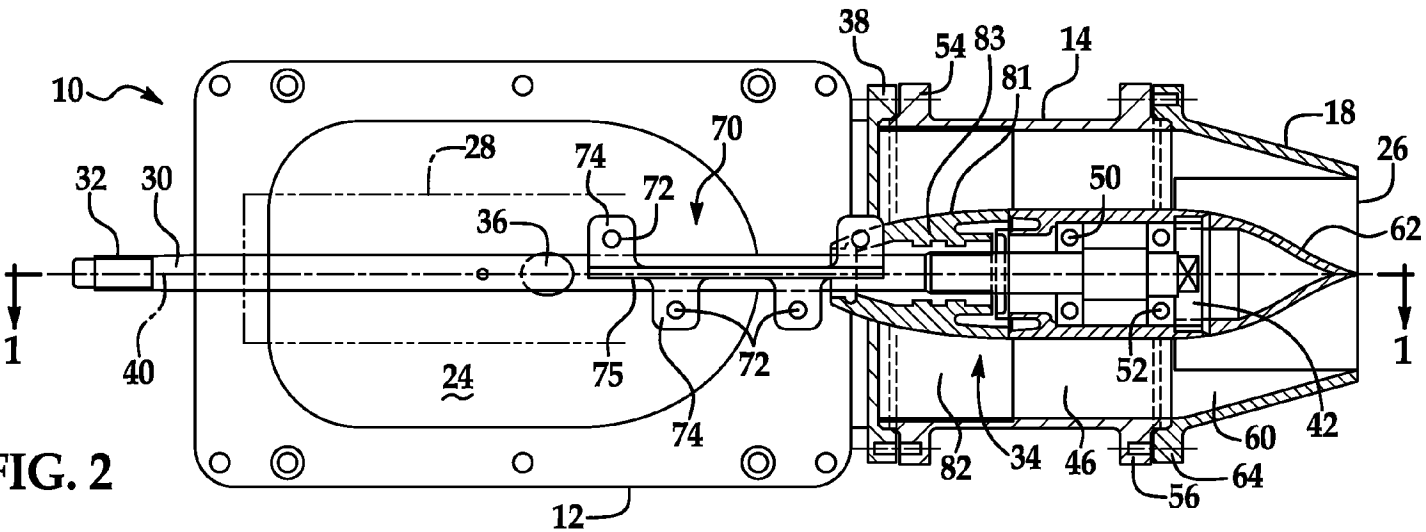
FIG. 2 is cross-section taken at plane 2-2 of FIG. 1.

The water induction system 10 for propelling a boat with a water jet includes an intake duct 12, a stator housing 14 secured to the trailing side of the intake duct by a series of annually spaced attachments 16, such as bolts or screws, and a nozzle 18, secured to the outlet end of the stator by a series of angularly spaced attachments 20. Although the intake duct 12 is shown as a component separate from the hull of the component of the watercraft, it may be formed integrally with the hull.

The intake duct 12 is a shell, formed preferably of molded plastic having an intake 24, through which water is inducted and flows toward an outlet 26 in the nozzle 18 along a path 22. The intake duct 12 is formed with a cylindrical tube 28 that extends axially. A drive shaft 30, which is splined to an engine shaft at 32, extends through cylinder 28 and into an impeller 34, to which the shaft is driveably connected. Shaft 32 extends through a hole 36 formed in the outer wall of intake duct 12. The exit side of duct 12 is formed with a flange 38, on which a series of angularly spaced bosses are formed and through which the attachment bolts 16 extend.

The streamline 22 represents the path and direction of flow of water from the inlet 24, through intake duct 12, impeller 34, stator 14 and nozzle 18 to the outlet 26.

Stator 14 encloses a cylindrical space containing the impeller 34, and is formed with angularly spaced blades 46 and a cylinder 48 containing bearings 50, 52, on which driveshaft 30 and impeller 34 are supported for rotation about axis 40. Bearings 50 and 52 are protected by a seal 42 located in cylinder 48, which prevents entry of water and contaminants into the angular space between shaft 30 and the bearings.

The intake side of stator 14 is formed with a flange 54 formed with attachment holes, which are aligned with holes in a flange 38 of the intake duct 12 and through which the attachment bolts 16 are inserted to connect the intake duct and stator 14. Similarly, the outlet end of stator 14 is formed with a flange 56 formed with attachment holes, which are aligned with holes in a flange 64 of the nozzle 18 and through which the attachment bolts 20 are inserted to connect the stator and nozzle.

Nozzle 18 is preferably formed of molded plastic containing fins 60, angularly spaced about axis 40 and aligned with the trailing edge of the blades 46 formed in the stator 14. Supported on the outlet side of cylinder 48 is a cone 62, which extends into the nozzle 18 and along which water flows to the outlet 26.

Figure 4:
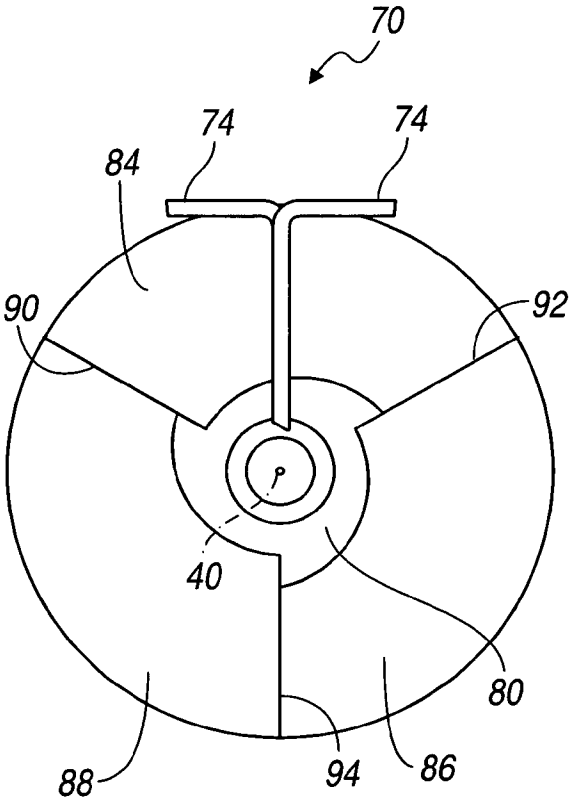
FIG. 4 is a front view of the sub-assembly shown in FIG. 3.
Figure 3:
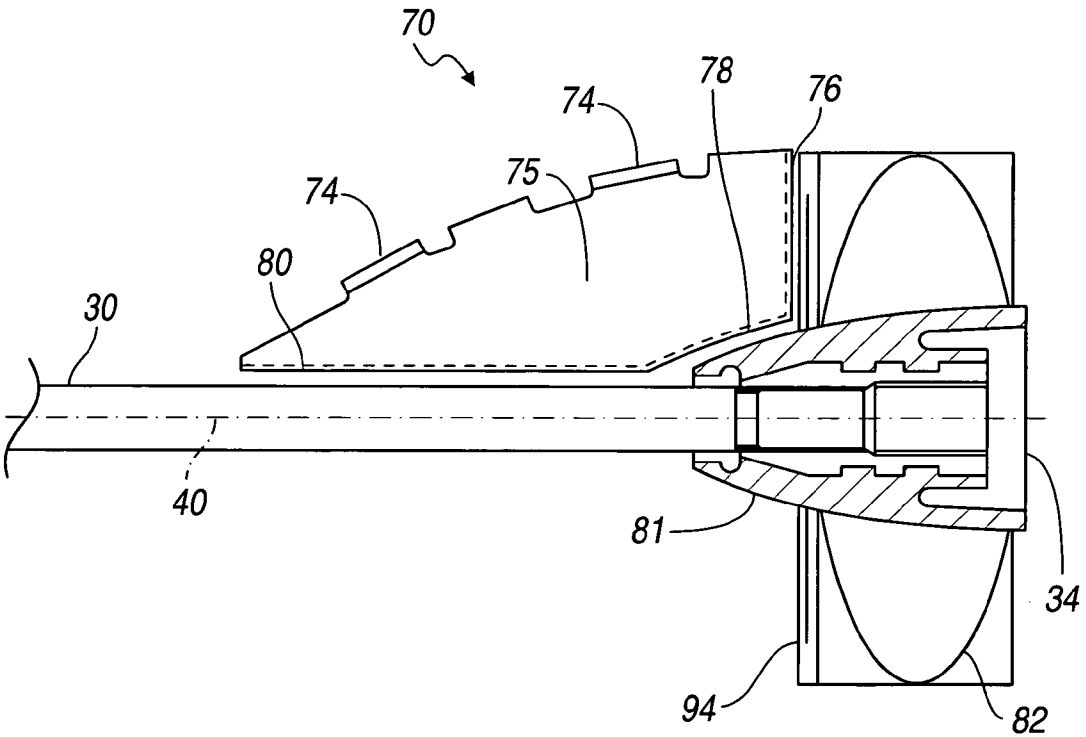
FIG. 3 is a side view showing the impeller, baffle and motor shaft.
Figure 5:
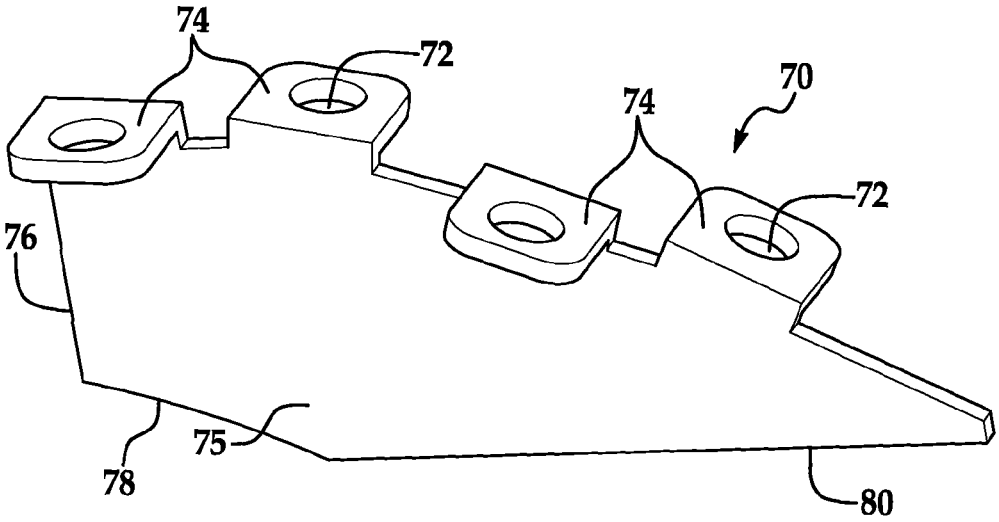
FIG. 5 is a perspective view of the baffle.

A baffle 70, preferably formed of stamped sheet metal, is secured by mechanical attachments located in holes 72 formed on fingers 74, which extend laterally outward from a central plane 75 of the baffle. As FIGS. 1, 3 and 4 show, baffle 70 includes at least three edges 76, 78, 80 formed on the periphery of plane 74. Cutting edge 76 is located adjacent the leading edge of the blades 82 formed on impeller 34 when those blades rotate to the position of the baffle 70, as shown in FIG. 3. Second cutting edge 78 is located adjacent the outer surface 81 of the impeller. Third cutting edge 80 is located adjacent the outer surface of driveshaft 30. A narrow gap preferably having a width between about 2 mm. and 4 mm. separates the cutting edges 76, 78, 80 from the adjacent surface 81 of the impeller 34, the leading edge of blades 78, and the surface of driveshaft 30, but the width of the gaps may be outside the range 2 mm. to 4 mm.

Figure 6:
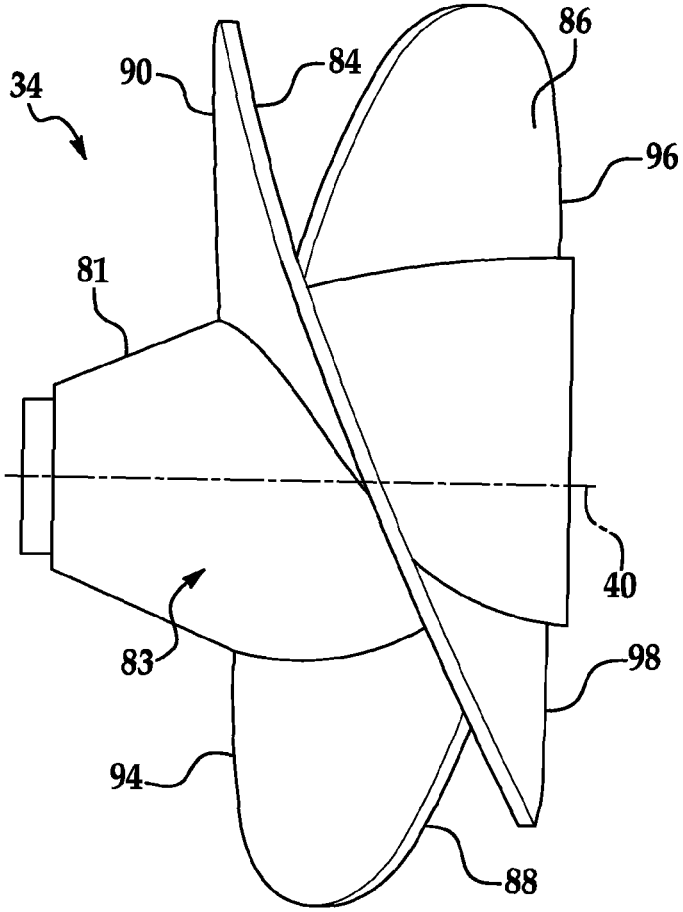
FIG. 6 is a side view of the impeller.

The blades 78 of impeller 34 comprise the three blades 84, 86, 88 shown in FIG. 6, which are secured to the outer surface 81 of hub 83 of impeller 34. Each blade extends along and around the axis of the impeller as a helix. The axial end of each blade that is closest to the intake duct 12 is formed with a leading edge that extends outward from axis 40, and the axial end of each blade that is closest to the nozzle 18 is formed with a trailing edge that extends outward from axis 40. Blade 84 has a leading edge 90; blade 86 has a leading edge 92, blade 86 has a leading edge 94. Blades 84, 86, 88 extend angularly about axis 40; therefore the blades overlap when viewed axially as in FIG. 4. The trailing edge 96 of blade 86 and the trailing edge 98 of blade 84 appear in FIG. 6.

Although the leading edges 90, 92, 94 of the impeller blades 84, 86, 88 are shown as straight in FIG. 4, they may be curved, and the cutting edge 76 may also be curved to conform to the shape of the leading edges. Although the impeller is shown with three blades, it may have four or more blades.

In operation, weeds and other debris carried by water from the intake 24 through the intake duct 12 to the entrance of the impeller 34 are cut or chopped into short lengths by the cutting edges 76, 78 82 formed on baffle 70. The leading edges 90, 92 94 of the respective impeller blades 84, 86, 88 pass close to the cutting edge 76 of baffle 70 as the impeller blades rotates about axis 40, thereby drawing weeds and debris entrained in the water to the cutting edges, where they are cut into short lengths as each impeller blade rotates past the cutting edge 76. Similarly, the outer surface 81 of the impeller 34 and the outer surface of shaft 30 draw weeds and debris to the second and third cutting edges 78, 80, where the weeds are cut into short lengths. After the weeds are cut into short lengths in this manner, the short weed lengths are carried in the water at high speed through the impeller 34, stator 14 and nozzle 18, exit through the outlet 26, and return to the water on which the watercraft is floating.

Figure 7:
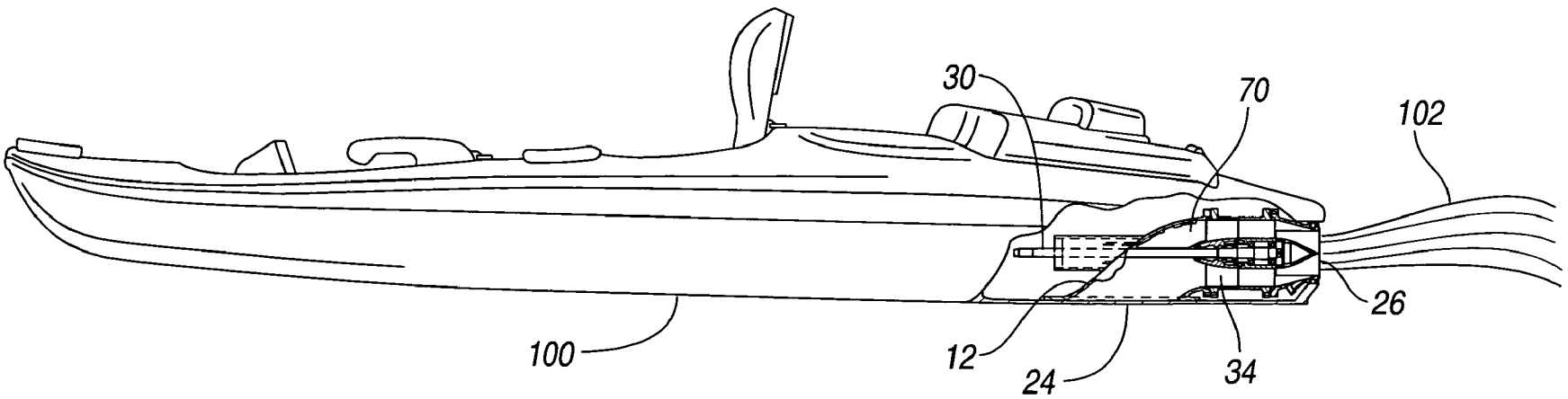
FIG. 7 is a side view of a jet powered kayak.

FIG. 7 shows the drive shaft 30, water intake duct 12, intake passageway 24, stator 14, baffle 70, impeller 34, nozzle 18 and outlet 26 installed in a jet-powered kayak 100. The water jet 102, which propels and steers the craft is seen rising from the nozzle's outlet 26 into the air above the water surface. An engine, located at the left-hand end of drive shaft 30, drives impeller 34, whose blades draw water into the system and force water in a high velocity jet 102 from the system.

In accordance with the provisions of the patent statutes, the preferred embodiment has been described. However, it should be noted that the alternate embodiments can be practiced otherwise than as specifically illustrated and described.

What is claimed is:

1. A device for cutting debris carried by water inducted into a jet stream that propels a watercraft, comprising:

an intake duct;

an outlet;

an impeller for pumping water from the intake duct to the outlet as the impeller rotates about an axis, the impeller including a hub formed with an outer surface, multiple blades secured to the hub, each blade including a leading edge projecting outward from the outer surface and spaced angularly from the leading edge of the other blades;

a baffle secured to the intake duct such that it does not move relative to the intake duct and including a cutting edge located adjacent and spaced from the leading edge of each blade when said leading edge rotates to the location of the cutting edge, the baffle including a second cutting edge facing the outer surface; and wherein the baffle includes a third cutting edge facing a surface of a drive shaft supported for rotation about the axis and driveably connected to the impeller.

2. The device of claim 1 wherein each of the blades is secured to the outer surface and the leading edge of each blade is directed outward from the outer surface.

3. The device of claim 1 wherein the cutting edge is spaced from the leading edge by a first gap, the second cutting edge is spaced from the outer surface by a second gap, and the cutting edge is spaced from the surface of the drive shaft by a third gap.

4. The device of claim 1 wherein:

the cutting edge is directed outward from the axis;

the leading edge of each blade is substantially parallel to the cutting edge and is located at an intake end of the blade.

5. The device of claim 1 wherein the baffle includes:

a plate formed with the cutting edge facing the leading edge of each of the blades, the second cutting edge facing the outer surface, the third cutting edge facing the surface of the drive shaft, and fingers extending laterally from a plane and secured to an inner surface of the intake duct.

6. The device of claim 1 wherein each of the blades extends in a helix along the outer surface of the impeller between the intake duct and the outlet, extends outward from the outer surface and is located in an annular space surrounding the impeller.

7. The device of claim 1 further comprising:

a stator secured to the intake duct, providing a passageway for water flowing from the intake duct to the outlet, and including a inner surface surrounding the impeller; and a nozzle secured to the stator, providing a passageway for water flowing from the stator to the outlet, and including a conical inner surface whose radius decreases as distance from the stator toward the outlet increases.

8. A device for cutting debris carried by water inducted into a housing, comprising:

an intake;

an outlet;

an impeller for pumping water from the intake to the outlet as the impeller rotates about an axis, the impeller including a hub formed with an outer surface and a blade secured to the hub and formed with a leading edge facing the intake;

a baffle secured against movement relative to the intake and including a cutting edge located adjacent the leading edge when the leading edge rotates to the location of the cutting edge, the baffle including a second cutting edge facing the outer surface; and wherein the baffle includes a third cutting edge facing a surface of a drive shaft supported for rotation about the axis and driveably connected to the impeller.

9. The device of claim 8 wherein:

the impeller includes multiple blades each blade being formed with a leading edge facing the intake and directed outward from the axis; and the cutting edge is located adjacent the leading edge of each of the blades when a respective leading edge rotates to the location of the cutting edge.

10. The device of claim 8 wherein the blade is secured to the outer surface and the leading edge is directed outward from the outer surface.

11. The device of claim 8 wherein the cutting edge is spaced from the leading edge by a first gap, the second cutting edge is spaced from the outer surface by a second gap, and the third cutting edge is spaced from the outer surface of the drive shaft by a third gap.

12. A device for cutting debris carried by water inducted into a jet stream that propels a watercraft, comprising:

an intake duct;

an outlet;

a stator providing a passageway for water flowing from the intake duct to the outlet;

an impeller for pumping water from the intake duct to the outlet as the impeller rotates about an axis, the impeller being located in the stator and including a hub formed with an outer surface, multiple blades secured to the hub, each blade including a leading edge projecting outward from the outer surface and spaced angularly from the leading edge of the other blades;

a baffle secured to the intake duct such that it does not move relative to the intake duct and including a cutting edge located adjacent and spaced from the leading edge of each blade when said leading edge rotates to the location of the cutting edge, the baffle including a second cutting edge facing the outer surface;

a nozzle formed with the outlet, providing a passageway for water flowing from the stator to the outlet, and including a conical inner surface whose radius decreases as distance from the stator toward the outlet increases; and wherein the baffle includes a third cutting edge facing a surface of a drive shaft supported for rotation about the axis and driveably connected to the impeller.

13. The device of claim 12 wherein each of the blades is secured to the outer surface and the leading edge of each blade is directed outward from the outer surface.

14. The device of claim 12 wherein the baffle includes:

a plate formed with the cutting edge facing the leading edge of each of the blades, the second cutting edge facing the outer surface, the third cutting edge facing the surface of the drive shaft, and fingers extending laterally from a plane and secured to an inner surface of the intake duct.

* * * * *